US006142809A

United States Patent [19]

Fukunaga

[11] Patent Number: 6,142,809

[45] Date of Patent: Nov. 7, 2000

[54] IC SOCKET ASSEMBLY WITH TRACKING STRUCTURE

[75] Inventor: Masami Fukunaga, Kawaguchi, Japan

[73] Assignee: Enplas Corporation, Saitama-ken, Japan

[21] Appl. No.: 09/258,603

[22] Filed: Feb. 26, 1999

[30] Foreign Application Priority Data

Feb. 27, 1998 [JP] Japan ..... 10-063997
Feb. 27, 1998 [JP] Japan ..... 10-063998

[51] Int. Cl.[7] ..... H01R 13/62

[52] U.S. Cl. ..... 439/331; 439/73

[58] Field of Search ..... 439/331, 73

[56] References Cited

U.S. PATENT DOCUMENTS 5,100,332 3/1992 Egawa ..... 439/331
5,139,437 8/1992 Ikeya et al. ..... 439/331
5,186,642 2/1993 Matsuoka et al. ..... 439/331
5,460,538 10/1995 Ikeya ..... 439/331
5,609,497 3/1997 Kawabe ..... 439/331
5,791,915 8/1998 Kubo ..... 439/331
5,816,828 10/1998 Ikeya et al. ..... 439/331

FOREIGN PATENT DOCUMENTS 5-55488 6/1993 Japan ..... H01R 33/76

*Primary Examiner*—Neil Abrams
*Assistant Examiner*—Hae Moon Hyeon
*Attorney, Agent, or Firm*—Fish & Richardson P.C.

[57] ABSTRACT

1. An IC socket comprises a socket body in which an IC package is accommodated, a press cover mounted to the socket body to be rotatable, and a press member rotatably mounted through a hold shaft to the press cover. One of the socket body and the press member is provided with a guide convex portion projecting toward other thereof, and the other one of the socket body and the press member is provided with a guide groove for guiding the guide convex portion, in which the guide convex portion is adapted to be fitted into the guide groove in accordance with a closing operation of the press cover so that the press member moves vertically with respect to the IC package thereby to press the IC package.

15 Claims, 6 Drawing Sheets

IC SOCKET ASSEMBLY WITH TRACKING STRUCTURE

BACKGROUND OF THE INVENTION

1. Field of the Invention

The present invention relates to an IC socket for holding detachably an IC package.

2. Prior Art of the Invention

In a known structure of an IC socket of this type, an IC package is used for carrying out a performance test such as burn-in test or the like.

That is, the IC socket has a socket body, in which the IC package is accommodated, and a press (hold) cover pivotally attached to the socket body. The press cover pivots downward so as to press downward on the IC package accommodated in the socket body from an upper side of the IC package. A plurality of terminals disposed to the IC package are so pressed, by a predetermined pressure caused by the press cover, so as to be electrically connected to electrical conductive members disposed to the socket body.

However, in the conventional IC socket described above, the press cover pivots about a shaft or shaft pin (hereinafter, referred to as a shaft pin) of the socket body and does not move vertically from the upper side of the XC package toward a lower side thereof so as to press and hold the IC package. Therefore, since, when the press cover is rotated about the shaft pin, one portion of the press cover adjacent to the shaft pin presses the IC package in a first instance and, after that, another portion of the press cover far from the shaft pin presses it, it is difficult to press the IC package simultaneously by the one portion of the press cover and the other portion thereof.

As a result, the one portion of the IC package adjacent to the shaft pin, which is pressed by the press cover in a first instance, is subjected to a large pressure (large pressing force) thereby deforming the terminals disposed to the firstly pressed portion of the IC package.

SUMMARY OF THE INVENTION

The present invention is directed to overcome the foregoing problems. Accordingly, it is an object of the present invention to provide an IC socket capable of pressing in a balanced manner, the IC package so as to prevent terminals of the IC package from being damaged.

This and other objects can be achieved according to the present invention by providing, in one aspect, an IC socket comprising:

- a socket body in which an IC package is accommodated;
- a press cover mounted to the socket body to be rotatable; and
- a press member rotatably mounted through a hold shaft to the press cover,
- one of the socket body and the press member being provided with a guide convex portion projecting toward other thereof, and the other one of the socket body and the press member being provided with a guide groove for guiding the guide convex portion, wherein the guide convex portion is adapted to be fitted into the guide groove in accordance with a closing operation of the press cover so that the press member moves vertically with respect to the IC package thereby to press the IC package.

In a preferred embodiment of this aspect, the press member has a press surface and the IC package has a bottom surface mounted on the socket body and an upper surface opposite to the bottom surface, and when the guide convex portion is fitted into the guide groove, the press surface of the press member is positioned in parallel to the upper surface of the IC package.

The guide convex portion has a lead end leading to be fitted into the guide groove so as to provide a tapered shape. The guide grove is provided with a lead portion having tapered side walls so formed as to be tapered along a moving direction of the press member, respectively, and a position-correcting portion having side walls which extend from the tapered side walls along the moving direction so as to be parallel thereto, and the convex portion is inserted into the lead portion so as to be guided into the position-correcting portion so that the press surface of the press member is parallel to the upper surface of the IC package. The guide convex portion is disposed to the press member and the guide groove is disposed to the socket body. The guide convex portion is arranged on an extension line extending through a center axis of the hold shaft vertically with respect to the press surface of the press member.

The IC socket further comprises an urging means disposed between the hold shaft and the press cover for urging the hold shaft toward the press member, the press member pressing the IC package with an urging force of the urging means.

The press cover has an engagement member to be engaged to the socket body when the press cover is closed and disengaged therefrom while the press cover is opened.

The guide convex portion and the guide groove are composed of even pairs of the guide convex portions and the guide grooves, the respective paired guide convex portions and guide grooves being symmetrically arranged with respect to the press member. In another aspect of the present invention, there is also provided an IC socket comprising:

- a socket body in which an IC package is accommodated;
- a press cover having a slit and mounted to the socket body to be rotatable;
- a hold shaft rotatably and slidably provided in the slit of the press cover;
- a press member mounted to the press cover so that the hold shaft penetrates through the press member, the press member being rotated and slid together with the hold shaft; and urging means disposed between the hold shaft and the press cover so as to urge the hold shaft toward the press member so that, when the press cover is closed, the press member presses the IC package by an urging force of the urging means.

In a preferred embodiment of this aspect, the urging means comprises a coil spring adapted to elastically urge the hold shaft. The coil spring, preferably a conical coil spring, is provided with one end surface contacting the press cover and another end surface contacting the hold shaft, both of the end surfaces being formed as flat surfaces. The conical coil spring is provided with one end surface having a first diameter and another end surface having a second diameter which is smaller than the first diameter, the one end surface contacting the press cover and the another end surface contacting with a longitudinal middle portion of the hold shaft.

The press cover is mounted to the socket body to be pivotal through a shaft and a longitudinal direction of the slit accords with a tangential direction of a circle defined around the shaft.

According to the above one aspect of the present invention, since the guide convex portion and the guide groove are provided for the IC socket so that the cooperation of the guide convex portion and the guide groove makes the press member move vertically with respect to the IC package so as to press the IC package, it is possible to press the wide-ranging area of the IC package in a balanced condition. Therefore, terminals adjacent to a shaft pin in all terminals are not pressed hard in a first instance, making it possible to prevent the terminals adjacent to the shaft pin from being deformed or damaged.

Furthermore, since the guide convex portion has the lead end so as to be tapered, the tapered lead portion of the guide convex portion permits the convex portion to be easily fitted into the guide groove so as to securely move the press member vertically with respect to the IC package.

Moreover, because the guide groove is provided with the lead portion and the position-correcting portion, it is possible to improve the fitting characteristic of the guide portion is groove is convex portion into the guide groove.

Still furthermore, because the guide convex disposed to the press member and the guide disposed to the socket body, a distance between the hold shaft and the guide convex portion is unchanged so that, after the guide convex portion is inserted into the guide groove, the press member always moves at a regular verticality, thereby pressing the IC package correctly.

Still furthermore, since the guide convex portion is arranged on the extension line extending through the center axis of the hold shaft vertically with respect to the press member, so that, after a position of the press member is corrected, it is possible to direct the pressing force acting on the press member toward the vertical direction, whereby unnecessary force except for the vertically pressing force does not act on the press member.

Still furthermore, since even pairs of the guide convex portions and the guide grooves, for example two pairs thereof, are provided for the IC socket, a correction force for vertically moving the press member is dispersed in the respective paired guide convex portions and the guide grooves, so that no large pressure acts on one portion of the IC package. Therefore, it is possible to correct the position of the press member smoothly and to reduce an operation force of the press cover.

On the other hand, according to another aspect of the present invention mentioned above, by making the urging force, which is caused by, preferably an elastic member as the urging means, act on the hold shaft of the press member, the urging force does not act on the press member so as to correct the position thereof at a given angle, whereby the urging force permits the press member to freely rotate about the center axis of the hold shaft as far as the press member contacts the IC package. Therefore, in the process of closing the press cover for pressing the IC package, the one portion of the press member adjacent to the shaft pin is firstly and partly in contact with the IC package.

However, while the one portion of the press member is partially in contact with the IC package, the urging force of the elastic member does not act on the IC package as the pressing force thereof, so that the partially contacting state between the press member and the IC package shifts to a state that the press surface of the press member is in contact with the upper surface of the IC package. After that, when the pressure cover is further rotated along the closing direction thereof, the urging force of the elastic member acts through the press member on the IC package, making it possible to press the IC package in a balanced manner.

Therefore, it is possible to prevent the IC package from being damaged.

Furthermore, using the coil spring as the elastic member makes it possible to sufficiently ensure a large elastic deformation amount of the coil spring as compared with using a plate spring, a belleville spring and so on.

Moreover, in the hold shaft, in a case where the lower end surface of the coil spring on the hold shaft side is not flat, when the contact position of the lower end surface of the coil spring is changed due to the rotation of the coil spring about a coil center axis at a given angle, a spring constant of the coil spring is changed in accordance with the contact position thereof so that the change of the pressing force with respect to the IC package is increased.

However, according to the present invention, since the coil spring is formed at its both end portions with the upper and lower flat surfaces, it is possible to subject the contact surface of the hold cover and the hold shaft to the pressing force in balance.

Still furthermore, since the one end surface having the first large diameter is in contact with the press cover and the other end surface having the second small diameter is in contact with the longitudinally middle portion of the hold shaft, the urging force of the coil spring is focused on the longitudinally middle portion thereof, and as a result, the focused urging force caused by the coil spring permits the press member to press the the IC package in a further balanced condition.

That is, since the coil spring contacts at its two different positions with the hold shaft, if one end surface of the coil spring having the large diameter is in contact with the hold shaft, a space between the two contact positions is wide. Therefore, in a case where one pressing force acting on one contact position is different from the other pressing force acting on the other contact position, the unbalanced biassing force described above seriously acts on the press member so that the pressing force acting on the IC package is unbalanced in every position thereof.

However, in this aspect of the present invention, because of focusing the urging force of the coil spring on the longitudinally middle portion of the hold shaft, it is possible to prevent the pressing force acting on the IC package from being unbalanced.

BRIEF DESCRIPTION OF THE DRAWINGS

The present invention will become apparent from the following description of preferred embodiments with reference to the accompanying drawings in which:

FIGS 5A–5D show a detail of a press member of the IC socket of the embodiment shown in FIG. 1, in which FIG. 5A is a plan view showing the press member, FIG. 5B is a front view showing the press member, FIG. 5C is a bottom view showing the press member, and FIG. 5D is a cross sectional view taken on line VD—VD of FIG. 5A;

FIGS 8A–8E show an operating condition of the IC socket, in which FIG. 8A is a front view, partially in cross section, showing an operation that the press cover is getting closed, FIG. 8B is a front view, partially in cross section, showing the operation that the press cover is getting closed continuously from the state of FIG. 8A, FIG. 8C is a front view, partially in cross section, showing the operation that the press cover is getting closed continuously further from the state of FIG. 8B according to the embodiment, FIG. 8D is a front view, partially in cross section, showing the operation that the press cover is getting closed continuously further from the state of FIG. 8C, and FIG. 8E is a front view, partially in cross section, showing an operation that the press cover is getting closed continuously further from the state of FIG. 8D.

DESCRIPTION OF THE PREFERRED EMBODIMENTS

The preferred embodiment of the present invention will be described hereinafter with reference to the accompanying drawings.

FIG. 1 to FIG. 8E show the preferred embodiment of the present invention.

Figure 4:
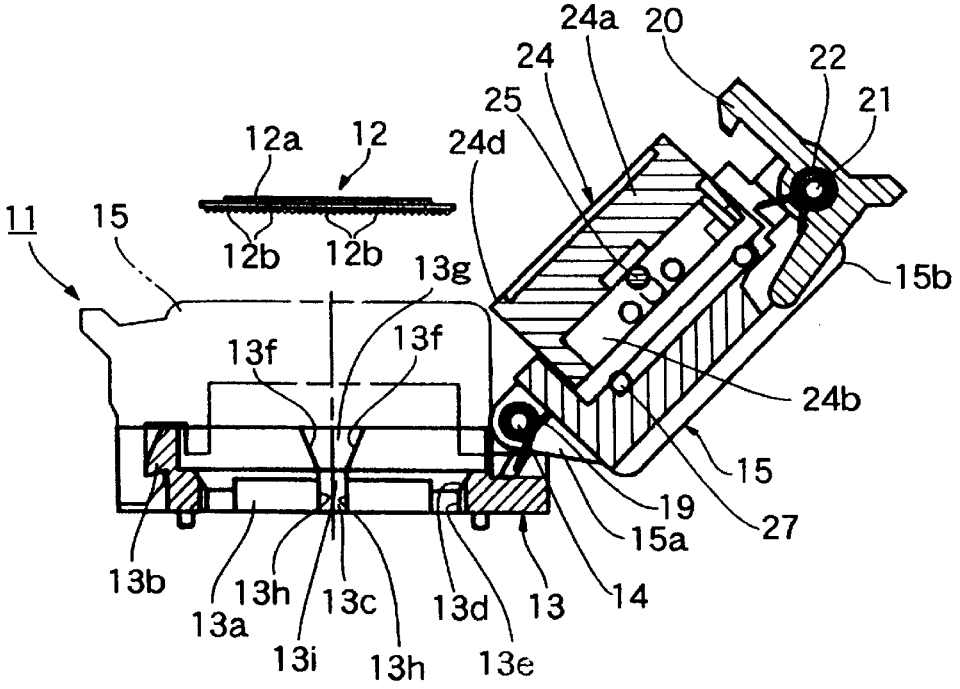
FIG. 4 is a cross sectional view showing the IC socket in a state that a press cover thereof is opened.

Referring first to a structure of the embodiment, reference numeral 11 represents an IC socket for detachably holding an IC package 12 shown in FIG. 4. In order to put the IC package 12 to a performance test, the IC socket 11 is adapted to electrically connect terminals 12*b* of the IC package 12 to a printed circuit board (not shown) of a tester, for example.

This IC package 12 is provided with a package body 12*a* having an upper surface and a bottom (lower) surface which are opposite to each other. Terminals 12*b* each having a ball shape are mounted on a peripheral portion of the lower surface of the package body 12*a* so as to project downward therefrom in a shown state.

The IC socket 11 has a socket body 13 in which the IC package 12 is inserted so as to be accommodated. A press (hold) cover 15 is pivotally disposed through a shaft pin 14 to the socket body 13. A press member 24 is disposed to the press cover 15. The hold cover 15 is adapted to pivot downward so as to press and hold, by the press member 24, the upper surface of the IC package 12 accommodated in the socket body 13 from an upper side of the IC package 12.

Figure 6:
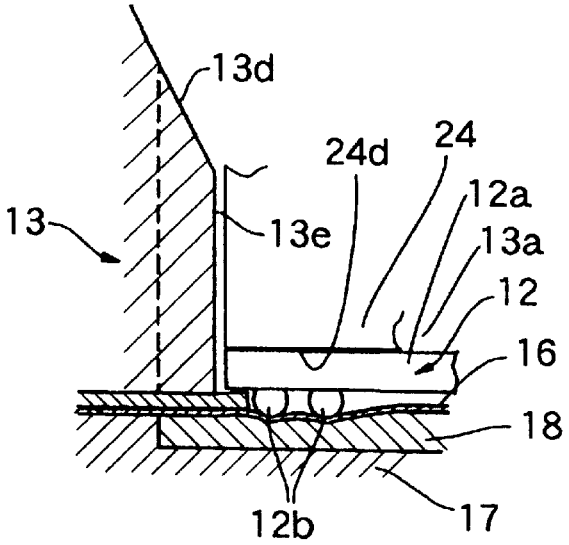
FIG. 6 is a cross sectional view showing the IC socket as the IC package is pressed by the press member.

The socket body 13, as shown in FIG. 6 and so on in detail, is formed with a concave portion 13*a* in which the IC package 12 is inserted and mounted while the position of the IC package 12 is fixed to a predetermined position. A tab film 16 having an electrode pattern is mounted on a bottom surface of the concave portion 13*a*, in a state of FIG. 6, and the electrode pattern of the tab film 16 can be electrically connected to the arrangement of the terminals 12*b* of the IC package 12.

A substrate 17 is arranged below the tab film 16 and an elastic member 18 made of, for example, silicon, is arranged below of the electrode pattern of the tab film 16 so that the elastic member 18 is inserted between the electrode pattern thereof and the substrate 17. The IC package 12 is connected through the tab film 16 to the printed circuit board arranged below the substrate 17.

On the other hand, the press cover 15 has one base end portion 15*a* pivotally disposed through the shaft pin 14 to the socket body 13 so that the press cover 15 is biased toward a direction to be opened by a first spring member 19. The press cover 15 is provided at its other end portion 15*b* with a latch member 20 rotatably attached thereto through a pivot shaft or pin 21. The latch member 20 is possible to be engaged to an engagement portion 13*b* provided for the socket body 13 and disengaged therefrom.

Figure 1:
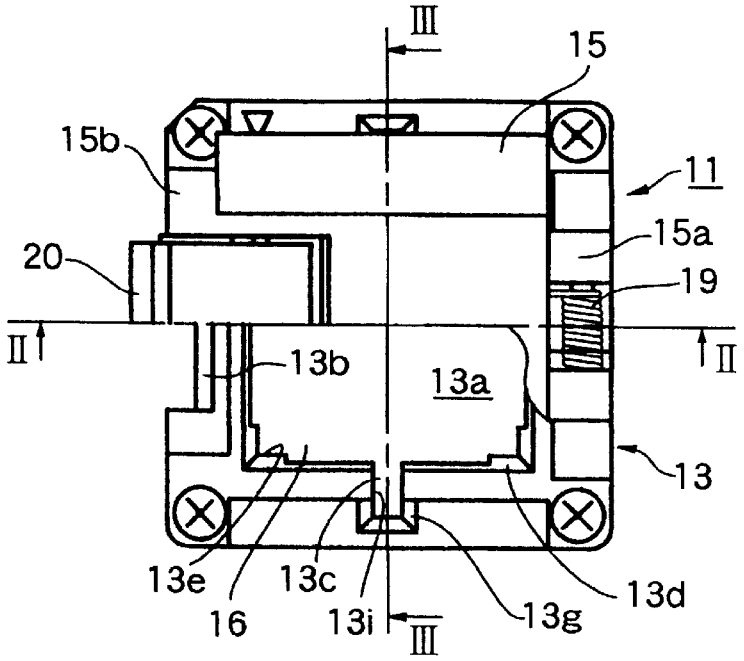
FIG. 1 is a plan view showing an IC socket according to an embodiment of the present invention.
Figure 2:
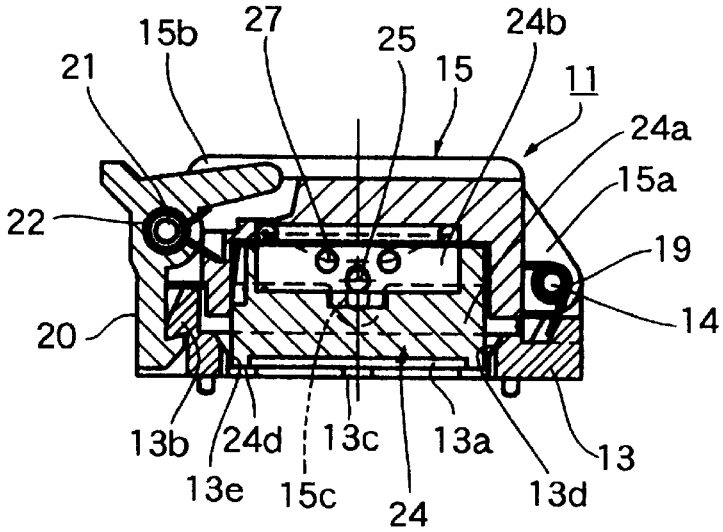
FIG. 2 is a cross sectional view taken on line II-II of FIG. 1.

The latch member 20 in FIG. 4 is urged by a second spring member 22 toward a counter-clockwise direction, that is, an engagement direction. The press cover 15 is rotated toward a closing direction thereof, and when the press cover 15 has just been closed, the latch member 20 is engaged to the engagement portion 13*b* as shown in FIG. 2.

Figure 5A:
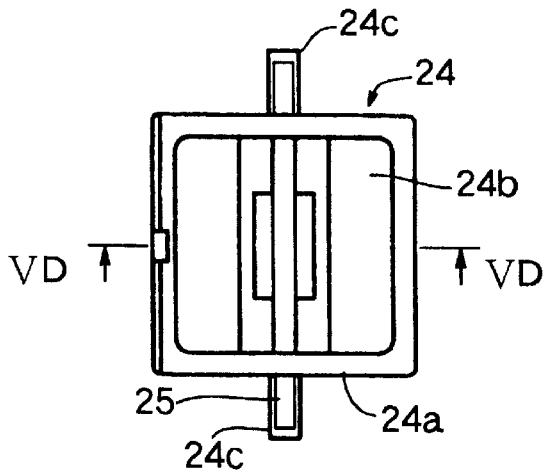
Figure 5C:
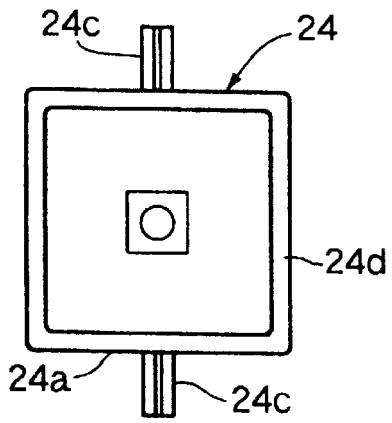

When the press cover 15 has been closed, the press member 24 presses the upper surface of the IC package 12 from an upper side thereof. That is, the press member 24, as shown in FIG. 5A and other figures, is provided with a press member body 24*a* having substantially a rectangular parallelepiped shape through which a hold (support) shaft 25 is penetrated. Both end portions of the hold shaft 25 projects from both side surfaces of the body 24*a*, and a middle portion of the hold shaft 25 is exposed from a concave portion 24*b* mounted on an upper surface of the body 24*a*.

Figure 3:
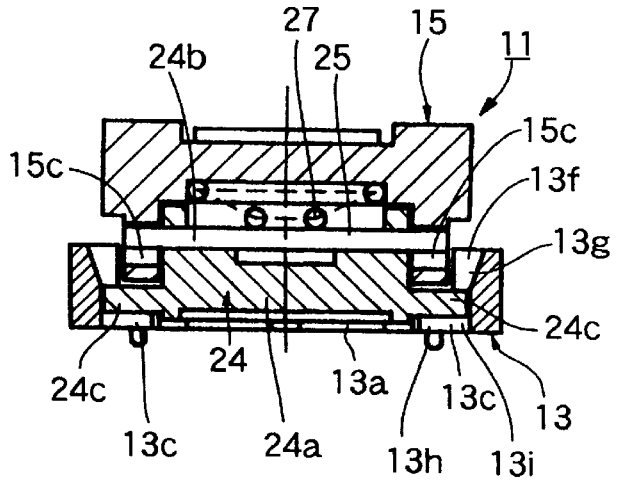
FIG. 3 is a cross sectional view taken on line III-III of FIG. 1.

Both the end portions of the hold shaft 25 projecting from the side surfaces of the body 24*a*, as shown in FIG. 3 and so on, are inserted in long holes (slits) 15*c* formed to the press cover 15 so that the press member 24 and the hold shaft 25 are able to rotate and move in parallel to a longitudinal direction of the slit 15*c*, together. The longitudinal direction of the slit 15*c* accords with a tangential direction of a circle defined around the shaft pin 14 of the press cover 15.

Figure 5B:
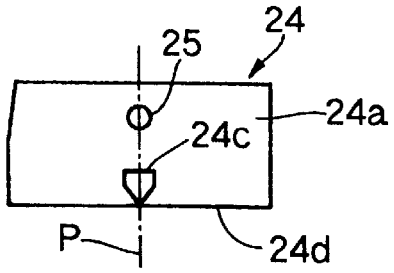
Figure 5D:
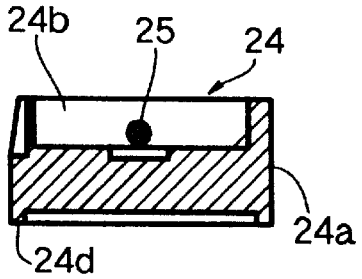

To the press member 24, guide convex portions 24*c* are so disposed so as to project from side surfaces of the press member 24. The guide convex portions 24*c* may be guided by guide grooves 13*c* formed to the socket body 13 described hereinafter in detail. Each of the guide convex portions 24*c* is arranged on each extension line P extending through a center axis of the hold shaft 25 vertically with respect to a press surface 24*d* of the press member 24 as shown in FIG. 5B. Each of the guide convex portions 24*c* has a lead end which leads to be fitted into each of the guide grooves 13*c* and the lead end of each of the guide convex portions 24*c* is tapered.

Figure 7:
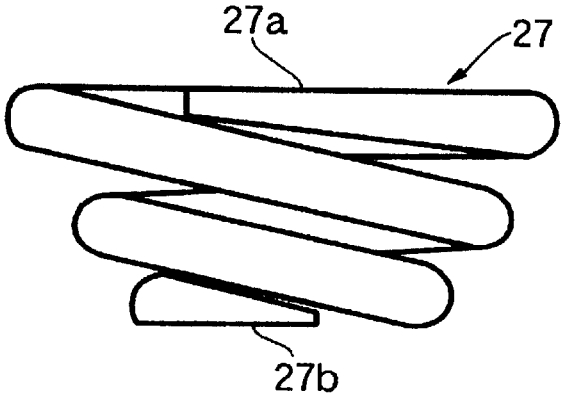
FIG. 7 is a front view of a conical coil spring of the IC socket according to the embodiment.

A conical coil spring as an elastic member 27 is arranged between the hold shaft 25 of the press member 24 and the press cover 15 so as to elastically urge the hold shaft 25 toward the press member 24. The conical coil spring 27, as shown in FIG. 7, is provided with an upper end surface which is polished so as to be formed as an upper flat surface 27*a*. The conical coil spring 27 is also provided with a lower end surface having a diameter which is smaller than that of the upper end surface. The lower end surface of the conical coil spring is polished so as to be formed as an lower flat surface 27*b*. The whole upper flat surface 27*a* is in contact with the hold cover 15 and the lower end surface 27*b* is in contact with the longitudinally middle portion of the hold shaft 25.

Figure 8A:
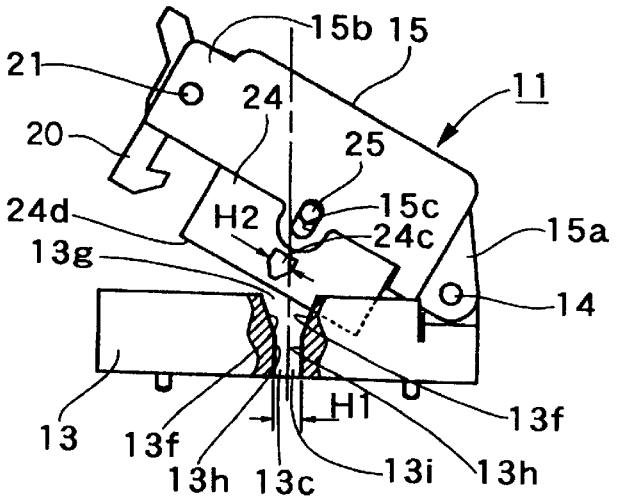
Figure 8B:
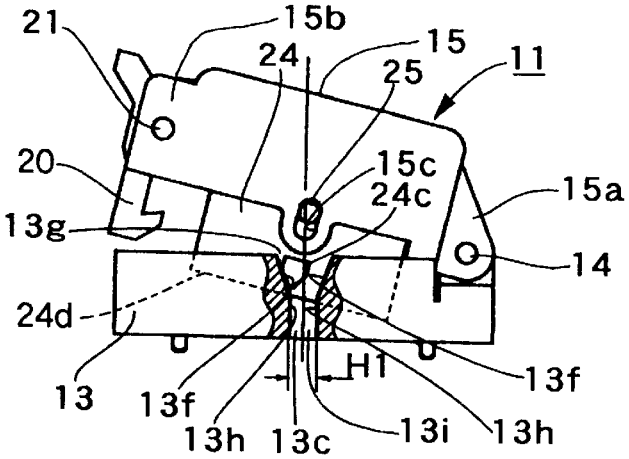

On the other hand, as shown in FIGS. 2, 4 and so on, an upper end portion of the inner wall of the concave portion 13*a* is formed with an inclined surface 13*d*, respectively. The inner wall of the concave portion has a vertical surface 13*e* which is so formed as to extend from a lower end portion of the inclined surface 13*d*. The guide groove 13*c* such as shown in FIG. 4 is provided with a lead portion 13*g* having tapered side walls 13*f*, respectively. That is, each of the side walls 13*f* is tapered toward the concave portion 13*a*. The guide groove 13*c* also has a position-correcting portion 131 having side walls 13*h* which extend from the side walls 13*f* toward the concave portion 13*a* so as to be parallel to the vertical direction to each other. When the guide convex portion 24*c* is inserted into the lead portion 13*g*, the guide convex portion 24*c* is guided through the lead portion 13*g* to the position-correcting portion 131 thereby being inserted therein so that the guide convex portion 24*c* is capable of moving vertically with respect to the IC package 12. The position-correcting portion 131 is formed so that a width H1 of the position-correcting portion 131 is the same as a width H2 of the guide convex portion 24*c* as shown in FIG. 8A and the like.

By cooperation of the guide convex portion 24*c* and the guide groove 13*c*, while the press cover 15 is closed, the press member is also moved vertically with respect to the IC package 12 so as to press the IC package 12.

In addition, two pairs of the guide convex portions 24*c* and the guide grooves 13*c* are symmetrically arranged with respect to the press member 24. Incidentally, even pairs of the guide convex portions 13*c* and the guide grooves 13*c* may be symmetrically arranged with respect to the press member 24.

Incidentally, in this specification, as described above, "vertical direction" is employed to mean "a direction which is vertical with respect to the IC package 12 mounted on the socket body 13, "an upper side and other similar descriptions" are employed to mean "an upper side of the IC package 12 mounted on the socket body 13". Similarly, "a lower side and other similar descriptions" are employed to mean "a lower side of the IC package 12 mounted on the socket body 13".

Next, a method of using the IC socket 11 having the above structure is explained hereinafter.

Figure 8C:
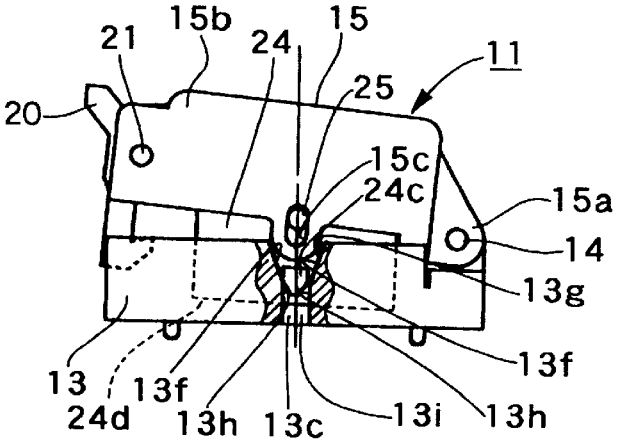

At first, the IC package 12 is inserted into the concave portion 13*a* of the socket body 13 so as to be mounted on the tab film 16. After that, the press cover 15 is rotated, against the elastically urging force (elastic force) of the first spring member 19, along the closing direction thereof. When the press cover 15 is rotated from a state of press cover 15 shown in FIG. 8A to a state thereof shown in FIG. 8B, the guide convex portion 24*c* of the press member 24 slidably contacts the side walls 13*f* of the lead portion 13*g* of the guide groove 13*c*. When the press cover 15 is rotated along the closing direction furthermore, the guide convex portion 24*c* is guided into the lead portion 13*g* so as to be inserted into the position-correcting portion 13*i* as shown in FIG. 8C. When the guide convex portion 24*c* of the press member 24 is entirely inserted into the position-correcting portion 13*i*, the position of the press member 24 is corrected so that the press surface 24*d* thereof is parallel to the upper surface of the IC package 12, whereby it becomes possible for the press member 24 to move vertically with respect to the IC package 12.

Figure 8D:
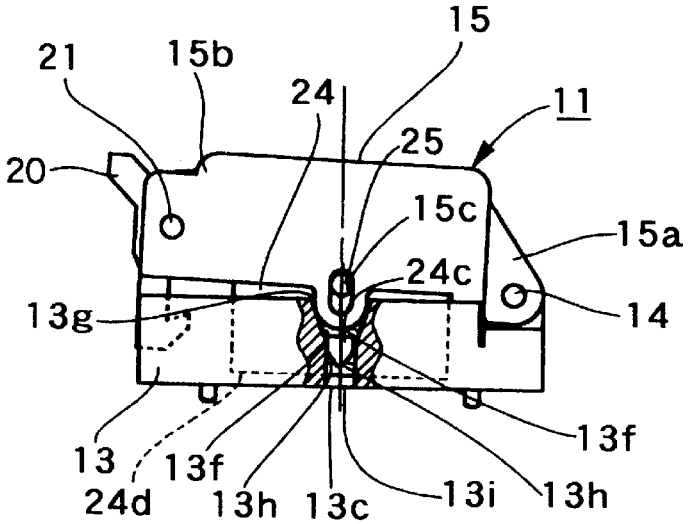
Figure 8E:
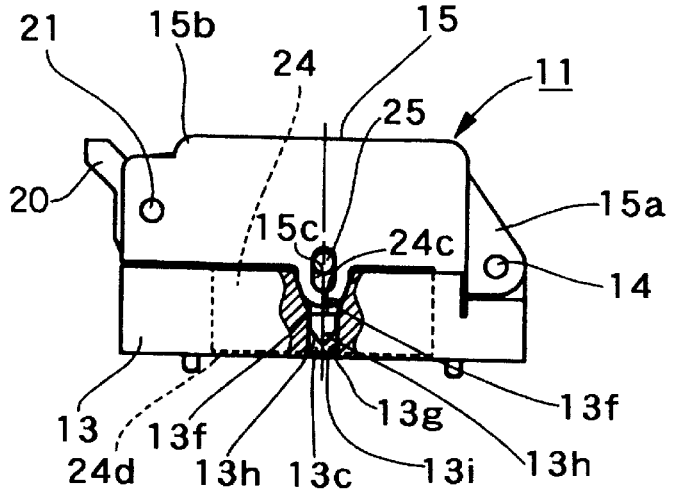

When the press cover 15 is further rotated along the closing direction from a state of the press cover 15 shown in FIG. 8D, the press surface 24*d* as the lower surface of the press member 24 moves downward toward the upper surface of the IC package 12 with the corrected position of the press member being maintained, that is, the press surface 24*d* keeps parallel to the upper surface of the IC package 12 so that the press surface 24*d* of the press member 24 contacts the upper surface of the IC package 12.

Further pivoting movement of the press cover 15 makes the latch member 20 engaged to the engagement portion 13*b* so that the press cover 15 has been closed. While the press cover 15 is closed, by the urging force of the conical spring member 27, the press surface 24*d* of the press member 24 is pressed through the hold shaft 25 so that the wide-ranging area of the upper surface of the IC package 12 is pressed in balance by the press surface 24*d* of the press member 24.

As described above, since the guide convex portion 24*c* and the guide groove 13*c* are provided for the IC socket 11 so that the cooperation of the guide convex portion 24*c* and the guide groove 13*c* makes the press member 24 move vertically from the upper side of the IC package 12 toward the IC package 12, it is possible to press the wide-ranging area of the upper surface of the IC package 12 in a balanced manner. Therefore, the terminals 12*b* adjacent to the shaft pin 14 are not pressed hard in a first instance, making it possible to prevent the terminals 12*b* adjacent to the shaft pin 14 from being deformed or damaged.

Particularly, in a case where the IC package 12 of the above structure has a compact size and the terminals 12*b* are made of gold, tin or other similar metal, it is very effective to press each of the terminals 12*b* in the balanced condition as in the present invention.

In the structure of the IC package 12 mentioned above, the tapered lead portion of the guide convex portion 24*c* permits the convex portion 24*c* to be easily fitted into the guide groove 13 so that it becomes possible to securely move the press member 24 vertically with respect to the IC package 12.

In addition, since the lead portion 13*g* and the position-correcting portion 13*i* are formed to the guide groove 13*c*, it is possible to improve the fitting characteristic of the guide convex portion 24*c* into the guide groove 13*c*.

Moreover, since the guide convex portion 24*c* is provided for the press member 24 and the guide groove 13*c* is provided for the socket body 13, the distance between the hold shaft 25 and the guide convex portion 24*c* is unchanged so that, after the guide convex portion 24*c* is inserted into the guide groove 13*c*, the press member 24 is always moved at a constant verticality, thereby pressing the IC package 12 correctly. Since the guide convex portion 24*c* is arranged on the extension line P extending from the center axis of the hold shaft 25 vertically toward the press surface 24*d* of the press member 24, so that, after the position of the press member 24 is corrected, it is possible to direct the pressure (pressing force) from the conical coil spring 27 acting on the press member 24 through the hold shaft 25 toward the vertical direction, whereby unnecessary force except for the vertically pressing force does not act on the press member 24. As a result, the operating force needed for closing the press cover 15 can be reduced.

In addition, because of providing the two pairs of the guide convex portion 24*c* and the guide groove 13*c*, the correction force for vertically moving the press member 24 is dispersed in the respective paired guide convex portions 24*c* and the guide grooves 13*c*, so that no large pressure acts on one portion of to IC package 12. Therefore, it is possible to correct the position of the press member 24 smoothly and to reduce the operating force of the press cover 15.

On the other hand, in this structure, by making the elastically urging force (elastic force), which is caused by the conical coil spring 27, act on the hold shaft 25 of the press member 24, it is possible to press the IC package 12 in a balanced condition through the press member 24 without the cooperation of the guide convex portion 24*c* and the guide groove 13*c*.

That is, by acting the elastic force of the conical coil spring 27 on the hold shaft 25 of the press member 24, the elastic force does not act on the press member 24 so as to correct the position thereof at a given angle whereby the elastic force permits the press member 24 to freely rotate about the center axis of the hold shaft 25 as far as the press member 24 contacts the IC package 12. Therefore, in the process of closing the press cover 15 thereby to press the IC package 12, the one portion of the press member 24 adjacent to the shaft pin 14 is firstly and partially in contact with the IC package 12. However, while the one portion of the press member is partially in contact with the IC package 12, the elastic force of the conical coil spring 27 does not act on the IC package 12 as the pressing force thereof, so that the partly contact state between the press member 24 and the IC package 12 shifts to a state that the press surface 24*d* of the press member 24 is in contact with the upper surface of the IC package 12. After that, when the press cover 15 is further rotated along the closing direction, the elastic force of the conical coil spring 27 acts through the press member 24 on the IC package 24, making it possible to press the IC package 12 in balance.

Incidentally, if another pressing structure having another coil spring for directly pressing the upper surface of the press member 24 is used in place of the above structure of this embodiment having the hold shaft 25 and the conical coil spring 27, till the press surface 24*d* of the press member 24 is in contact with the upper surface of the IC package 12, the correction force for correcting the position of the press member 24 acts thereon by the coil spring. Therefore, when the one portion of the press member 24 adjacent to the shaft pin 14 is partially in contact with the IC package 12, the one portion of the IC package 12 partially contacting with the press member 24 is subjected to a large pressing force, thereby damaging the terminals 12*b* disposed to the one partially contact portion of the IC package 12.

However, in this embodiment, since the elastic force of the conical coil spring 27 indirectly acts on the press member through the hold shaft 25, the elastic force of the conical coil spring 27 for correcting the position thereof at a given angle does not act on the press member 24, thereby pressing the IC package 12 in balance.

Therefore, because of making the elastic force of the coil spring 27 act on the hold shaft 25 of the press member 24, or making the guide convex portion 24*c* and the guide groove 13*c* cooperate as described above, it is possible to press the IC package 12 in balance. Moreover, it is able to combine the elastic force of the coil spring 27 with the cooperation of the guide convex portion 24*c* and the guide groove 13*c*, making it possible to gain the effects described above still more.

In this embodiment, because of using the coil spring like the conical coil spring 27, it is possible to sufficiently ensure a large elastic deformation amount of the conical coil spring 27 as compared with a case using a plate spring, a belleville spring and so on.

Furthermore, in the hold shaft 25, in a case where the lower end surface of the conical coil spring 27 on the hold shaft side is not flat, when the contact position of the lower end surface of the coil spring 27 is changed due to the rotation of the coil spring 27 about a coil center axis at a given angle, a spring constant of the coil spring 27 is changed in accordance with the contact position thereof so that the change of the pressing force with respect to the IC package 12 is increased.

However, in this embodiment described above, since the conical coil spring 27 is formed at its both end portions with the upper and lower flat surfaces 27*a* and 27*b*, it is possible to subject the contact surface of the press cover 15 and the hold shaft 25 to the pressing force in balance without increasing the change of the pressing force with respect to the IC package 12.

The conical coil spring 27 of this embodiment, as compared with a usual cylindrical coil spring, has a lower height. However, in the conical coil spring 27, the large elastic deformation amount and the large balanced pressing force are ensured in comparison with the usual cylindrical coil spring. Therefore, by arranging the conical coil spring 27 between the press cover 15 and the hold shaft 25, it is possible to make the size of the IC socket 11 compact and to increase the deformation amount of the press member 24.

In this embodiment, since the upper flat surface 27*a* on the upper side of the conical coil spring 27, which has the large diameter, is in contact with the press cover 15 and the lower end surface 27*b* on the lower side of the conical coil spring 27, which has the small diameter, is in contact with the longitudinally middle portion of the hold shaft 25, the elastic force of the coil spring 27 is focused on the longitudinally middle portion thereof.

The focused elastic force caused by the coil spring 27 permits the press member 24 to press in still more balance the IC package 12.

That is, since the conical coil spring 27 contacts at its two different positions with the hold shaft 25, if one end surface of the conical coil spring 27 having the large diameter is in contact with the hold shaft 25, a space between the two contact positions is wide. Therefore, in a case where one pressing force acting on one contact position is different from the other pressing force acting on the other contact position, the unbalanced pressing force described above seriously acts on the press member 24 so that the pressing force acting on the IC package 12 is unbalanced in every position thereof.

However, in this embodiment, because of focusing the elastic force of the coil spring 27 on the longitudinally middle portion of the hold shaft 25, it is possible to prevent the pressing force acting on the IC package 12 from being unbalanced.

Incidentally, in this embodiment, the guide groove 13*c* is formed to the socket body 13 and the guide convex portion 24*c* is formed to the press member 24. However, the present invention is not limited to the above structure. That is, the guide convex portion may be formed to the socket body and the guide groove may be formed to the press member. Moreover, in this embodiment, the guide convex portion is disposed to the press member so as to be arranged on the extension line P extending through the center axis of the hold shaft 25 vertically toward the press surface 24*d* of the press member 24, but the present invention is not limited to the above structure. That is, the guide convex portion may be disposed to another position of the press member.

Furthermore, in this embodiment, the conical coil spring 27 is used as the elastic member, but the present invention is not limited to the above structure. That is, a cylindrical coil spring, a plate spring, a belleville spring and other similar springs may be used as the elastic member.

While there has been described what is at present considered to be the preferred embodiment and modifications of the present invention, it will be understood that various other modifications may be made therein, and it is intended to cover in the appended claims all such modifications as fall within the true spirit and scope of the invention.

What is claimed is:

1. An IC socket comprising:

a socket body adapted to accommodate an IC package;

a press cover mounted to the socket body to be rotatable; and a press member rotatably mounted through a hold shaft to the press cover and having a press surface, one of said socket body and said press member being provided with a guide convex portion projecting toward the other thereof, and another one of said socket body and said press member being provided with a guide groove for guiding the guide convex portion, wherein said guide convex portion is adapted to be fitted into the guide groove in accordance with a closing operation of the press cover so that the press member moves vertically with respect to the IC package while keeping the press surface of the press member parallel to an upper surface of the IC package thereby to press the IC package.

2. An IC socket according to claim 1, wherein said IC package has a bottom surface mounted on the socket body, said upper surface being opposite to the bottom surface, and wherein when the guide convex portion is fitted into the guide groove, said press surface of the press member is positioned in parallel to the upper surface of the IC package.

3. An IC socket according to claim 1, wherein said guide convex portion has a lead end leading to be fitted into the guide groove so as to provide a tapered shape.

4. An IC socket according to claim 1, wherein said guide groove is provided with a lead portion having tapered side walls so formed as to be tapered along a moving direction of the press member, respectively, and a position-correct portion having side walls which extend from the tapered side walls along the moving direction so as to be parallel thereto, and wherein said guide convex portion is inserted into the lead portion so as to be guided into the position-correct portion so that the press surface of the press member is parallel to the upper surface of the IC package.

5. An IC socket according to claim 1, wherein said guide convex portion is disposed to the press member and said guide groove is disposed to the socket body.

6. An IC socket according to claim 1, wherein said guide convex portion is arranged on an extension line extending through a center axis of the hold shaft vertically with respect to the press surface of the press member.

7. An IC socket according to claim 1, further comprising an urging means disposed between the hold shaft and the press cover for urging the hold shaft toward the press member, said press member pressing the IC package with an urging force of the urging means.

8. An IC socket according to claim 1, wherein said press cover has an engagement member to be engaged to the socket body when the press cover is closed and disengaged therefrom while the press cover is opened.

9. An IC socket according to claim 1, wherein said guide convex portion and said guide groove are composed of even pairs of the guide convex portions and the guide grooves, said respective paired guide convex portions and guide grooves being symmetrically arranged with respect to the press member.

10. An IC socket comprising:

a socket body adapted to accommodate an IC package;

a press cover having a slit and mounted to the socket body to be rotatable;

a hold shaft rotatably and slidably provided in the slit of the press cover;

a press member rotatably mounted through the hold shaft to the press cover so that the hold shaft penetrates through the press member; and an urging means disposed between the hold shaft and the press cover so as to urge the hold shaft toward the press member so that, when a press surface of the press member is in contact with an upper surface of the IC package according to a rotation of the press cover, an urging force of the urging means indirectly acts on the press member through the hold shaft so that the press member presses the IC package.

11. An IC socket according to claim 10, wherein said urging means comprises a coil spring adapted to elastically urge the hold shaft.

12. An IC socket according to claim 11, wherein said coil spring is provided with one end surface contacting the press cover and another end surface contacting the hold shaft, both of said end surfaces being formed as flat surfaces.

13. An IC socket according to claim 12, wherein said coil spring is a conical coil spring.

14. An IC socket according to claim 13, wherein said conical coil spring is provided with one end surface having a first diameter and another end surface having a second diameter which is smaller than the first diameter, said one end surface contacting the press cover and said another end surface contacting with a longitudinal middle portion of the hold shaft.

15. An IC socket according to claim 10, wherein said press cover is mounted to the socket body to be pivotal through a shaft and a longitudinal direction of said slit accords with a tangential direction of a circle defined around the shaft.

* * * * *